United States Patent [19]

Gentiluomo

[11] 3,937,475

[45] Feb. 10, 1976

[54] GOLF GAME

[76] Inventor: Joseph A. Gentiluomo, 1456 Belmont Ave., Schenectady, N.Y. 12308

[22] Filed: Sept. 28, 1973

[21] Appl. No.: 401,638

Related U.S. Application Data

[62] Division of Ser. No. 204,890, Dec. 6, 1971, Pat. No. 3,784,207.

[52] U.S. Cl. ..... 273/176 FA; 273/185 R

[51] Int. Cl.[2] ..... A63B 67/02; A63B 69/36

[58] Field of Search ..... 273/176–182, 273/184, 185

[56] References Cited

UNITED STATES PATENTS

| | | | |
|---|---|---|---|
| 1,894,814 | 1/1933 | Baker | 273/185 R |
| 2,450,125 | 9/1948 | Dunfee | 273/181 R |
| 2,954,232 | 9/1960 | Auer | 273/185 R |
| 3,091,466 | 5/1963 | Speiser | 273/185 R |
| 3,310,310 | 3/1967 | McKee | 273/181 R X |
| 3,559,996 | 2/1971 | Hopp | 273/176 FA |
| 3,784,207 | 1/1974 | Gentiluomo | 273/185 R |

FOREIGN PATENTS OR APPLICATIONS

| | | | |
|---|---|---|---|
| 16,272 | 8/1905 | United Kingdom | 273/176 FA |

*Primary Examiner*—George J. Marlo

[57] ABSTRACT

A golf game apparatus constructed and equipped for the playing of a game which lends itself to a handicap system whereby players of varying abilities can compete on a handicap adjusted scoring basis. The apparatus has a golf tee disposed at one end, a vertical target disposed at the opposite end for segregating balls on a directional accuracy basis and, a ball receiver for receiving and classifying balls gravitating from the vertical target. Scoring of each ball hit is provided by a numerical representation of directional accuracy. For playing the game, each player hits a predetermined number of balls with both wood and iron clubs in a prearranged sequence into the vertical target. This game can be extended to include also floor targets which can be disposed forward of each vertical target. For scoring purposes, these floor targets with associated controls have provisions for classifying and providing a numerical representation of all balls hit therein with short range irons. Scores of each shot taken are displayed on a counter situated on a score table located at each golf tee area.

10 Claims, 6 Drawing Figures

GOLF GAME

This is a division of application Ser. No. 204,890, filed Dec. 6, 1971, now U.S. Pat. No. 3,784,207.

Presently lacking are golfing facilities which place emphasis on golfing accuracy. Therefore, the aim of this invention is to provide golfers with a golf facility that will aid in developing golfing accuracy.

Accordingly, other objects of this invention are as follows:

To provide a golf game facility adaptable for use either indoors or outdoors.

To provide a golf game apparatus which can be installed in a building to provide year-round recreation.

To provide a golf game apparatus which lends itself to the playing of a variety of competitive type golf games.

To provide an apparatus for competitive type golf games which utilize wood, long iron, medium iron, and short iron clubs.

To provide an apparatus for competitive type golf games adaptable to a game rating such as men's and women's par, so that golfer handicaps can be established.

To provide an apparatus for competitive type golf games adaptable to league and tournament play.

To provide a golf game apparatus having means for providing the score of every shot hit from the golf ball tee.

To provide a game scoring system that can be adapted with a score projection unit to display player scoring for spectator viewing.

These objects and other objects of this invention should be discerned and appreciated from the description and claims taken in conjunction with the accompanying drawings in which:

In explaining the invention in detail, it can be discerned that this invention is capable of many embodiments of which the preferred is herein described and illustrated in the associated drawings.

In order to utilize the disclosed golf game apparatus, it is apparent that a supply of golf balls and standard commercially available golf clubs are required.

There are many variations of competitive type games that can be played within the said apparatus. The preferred game arrangement allows the player to perform by hitting a plurality of balls toward a vertical target with both wood and iron clubs. Also, if required, the player can hit a plurality of pitch or chip shots toward a floor target with a short range iron club. Competing players can hit said balls in a variety of predetermined sequence arrangements, according to preference, to favor either medal or match play.

The vertical and floor targets will have both center and off-center areas. For accuracy scoring, balls hit into the center zone can be accorded a score of one, balls hit into the off-center zones can be accorded a score of two, and all other stroked balls can be accorded a score of three. In essence, balls hit into the center of the vertical target represents a ball hit straight down the fairway. Balls hit either to the right or left in the off-center portions of said target will represent balls that have been either sliced, hooked, pushed, or pulled. The floor target represents a green toward which players can pitch or chip balls with the intent of coming as close to the flagstick as possible. Balls hit into the center portion will indicate a very good shot to the green. Balls hit into the off-center portion will indicate that the player has hit within the perimeter of the green. Balls not hitting into either of said target areas indicate that the player has missed the green and has hit an undesirable shot which will usually lead to trouble on most golf courses.

It is to be discerned that the above cited scores can be displayed on a counter situated at a score table located adjacent to each golf tee. Said scores can in turn be recorded by players onto a score sheet positioned on said score table. A score projector unit attached to said table can then be used to project said scores from said score sheet onto a screen for spectator viewing.

The invention comprises a conventional type golf tee 10 with either manual or automatic teeing. Said golf tee 10 is fixedly positioned intermediate boundary lines 11, 11 and to surface of ground floor 12. Posts 15, 15 are fixedly anchored with respect to ground floor 12 and in line with substantially parallel boundary lines 11, 11.

Figure 3:
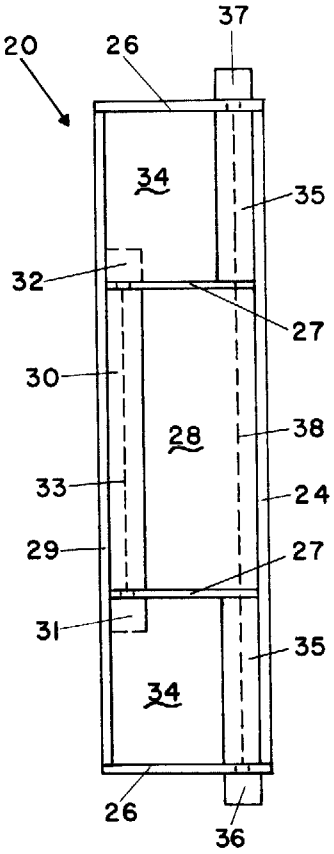
FIG. 3 shows an enlarged plan view of the ball receiver.
Figure 2:
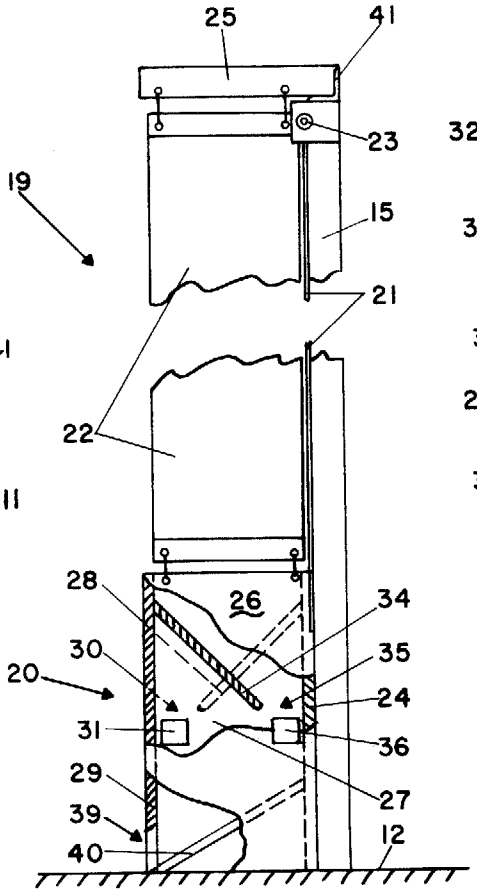
FIG. 2 shows an enlarged side elevation view of a typical vertical target and ball receiver arrangement with side of said ball receiver partly cut away.

At a fixed distance from golf tee 10 of golf lane 18, is substantially vertical target 19 and ball receiver 20. The vertical target 19 consist of target backstop 21 and upright baffles 22, 22. Said baffles are disposed vertically with their planes oriented substantially perpendicular with respect to said target backstop 21 to establish center and off-center target areas. Therefore, adjacent to the center target area both to the right and the the left, will be what is known as the off-center target areas. Center and off-center areas of said discrete vertical target are coextensive with center and off-center sections of said in-line discrete ball receiver 20. The plurality of vertically suspended baffles 22, 22 are tautly and fixedly mounted between overhang supports 25, 25 and top edges of side pieces 26, 26 and partitions 27, 27 of said ball receiver as shown in FIGS. 2 and 3. The said baffles 22, 22 are fabricated from a material such as reinforced plastic sheet. Said overhang supports 25, 25 are disposed in sets of four directly over and in vertical alignment with the side pieces 26, 26 and partitions 27, 27 of said ball receiver 20. All overhang supports 25, 25 are fixedly mounted to structural tie means 41 which is fixedly mounted with respect to the tops of posts 15, 15. The target backstop 21 is fabricated from a material such as reinforced plastic sheet and is securely fastened by conventional means between cable 23 and the top of rear piece 24 of said ball receiver 20. Cable 23 is fixedly mounted between tops of posts 15, 15. There are four baffles per vertical target 19 and all are suspended and properly secured in close proximity with respect to backstop 21.

Figure 1:
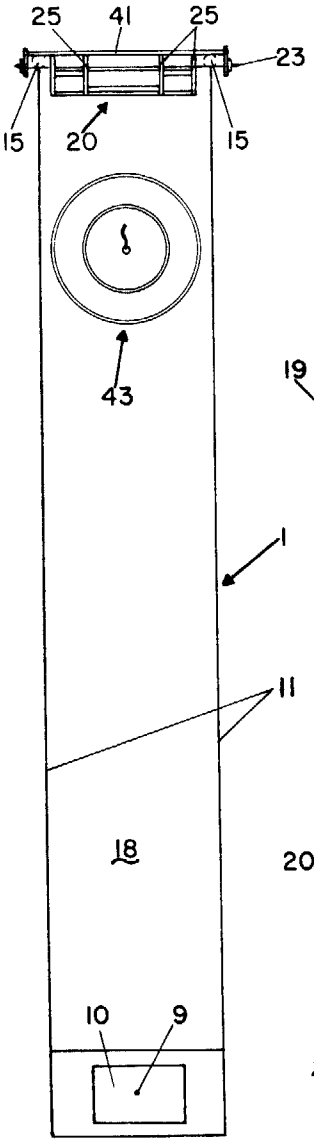
FIG. 1 shows a schematic plan view of a typical golfing apparatus.

Ball receiver 20 is fixedly mounted to ground floor 12 between posts 15, 15 of golf lane 18 as shown in FIGS. 1 and 2. By referring to FIGS. 2 and 3 it can be discerned that said ball receiver 20 resembles a rectangular structure with an open top to serve as a ball entrance. Internally, said ball receiver 20 is divided into three sections by partitions 27, 27 which are fixedly mounted in a substantially vertical manner and extending from top of said rectangular like structure to inclined ramp 40. The center section lies between partitions 27, 27 and the off-center sections lie between said partitions and side piece 26. Center chute 28 is fixedly mounted between partitions 27, 27 and inclined downwardly toward front mask 29. Also, said chute 28 is of such size as to provide opening 30 for passage of golf balls. Fixedly mounted to sides of partitions 27, 27 is a ball detection means such as photoelectric components 31 and 32 which are disposed to detect the passage of balls through said opening 30 by use of light rays 33. The off-center ball receiver sections contain chutes 34, 34 which slope downwardly toward rear piece 24 of said ball receiver 20. Said chutes 34, 34 are of such size as to allow passage of golf balls through openings 35, 35. Fixedly mounted to side pieces 26, 26 is a ball detection means such as photoelectric unit components 36 and 37 which utilizes light rays 38 underneath openings 35, 35 to detect balls passing through said openings. Underneath chutes 28 and 34 is an inclined ramp 40 which compels balls to discharge out from within the ball receiver 20 through opening 39 located at the bottom of front mask 29.

Figure 4:
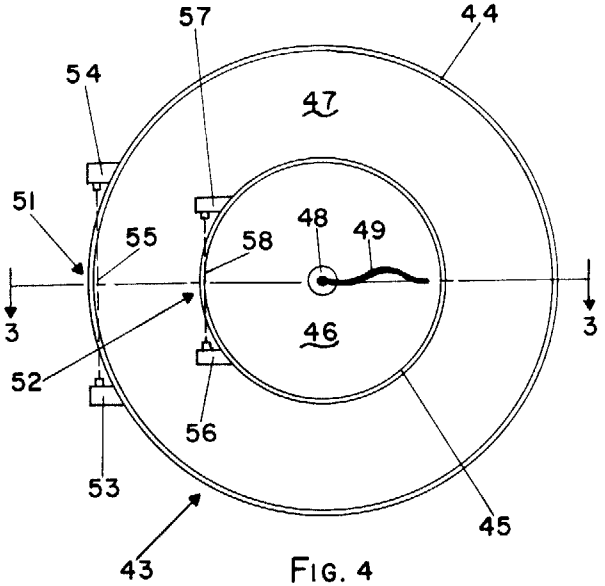
FIG. 4 shows an enlarged plan view of a typical floor target.
Figure 5:
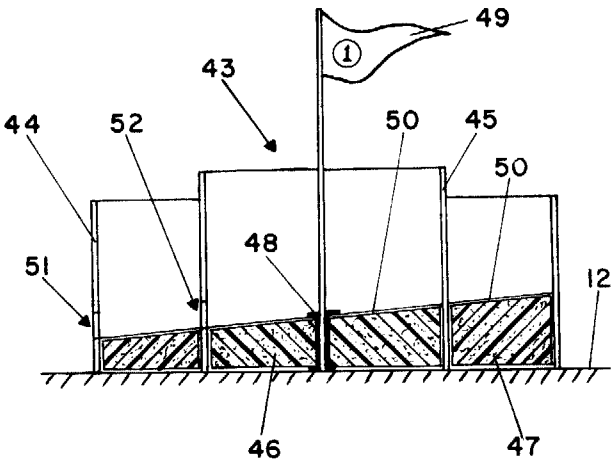
FIG. 5 shows an enlarged elevation view, in section, taken on line 3—3 of FIG. 4.

Floor target 43 is fixedly mounted with respect to ground floor 12 within lane 18 and disposed in front of said ball receiver 20. Said floor target is constructed of two upright annulus ring walls 44 and 45 and made of a material such as plastic. The cited annulus rings are maintained in place with respect to each other by the annulus cushion 47 which is tightly fitted between said annulus walls as shown in FIGS. 4 and 5. Within the center annulus ring 45 is a tightly inserted disc type cushion 46 containing a centrally positioned insert 48 fixedly associated with respect to said cushion for the purpose of supporting flagstick 49 in a substantially vertical manner. Cushions 46 and 47 are fabricated from a material such as flexible foam plastic with a sheet covering of a material such as flexible plastic covered cloth. Said cushions 46 and 47 are fabricated with an inclined top surface 50 to allow balls hit into said target to roll out through the openings 51 and 52 located in annulus walls 44 and 45. It should be discerned that if said floor 12 is inclined, said surface of cushions 46 and 47 need not be fabricated with said inclined top surface. Openings 51 and 52 are positioned at the lowest point of inclination of both cushions 46 and 47 and are of such size as to allow balls to roll freely through. Ball detection means such as photoelectric unit components 53 and 54 are fixedly mounted on wall of outer annulus ring 44 and positioned adjacent to opening 51 as shown in FIG. 4. This arrangement will allow light rays 55 to project horizontally across opening 51 for the purpose of detecting the passage of balls. Also, ball detection means such as photoelectric unit components 56 and 57 are fixedly mounted on wall of inner annulus ring 45 and positioned with respect to opening 52 so that light rays 58 will project horizontally across said opening 52.

If game scoring is not automated, a player or scorer must observe the trajectory of every ball hit toward the targets, in order to record the established target score. If game scoring is automated, it is not essential to observe the ball trajectory. Detection means are provided to assist in the scoring of each shot. Ball hit into the vertical target 19 are classified after falling downwardly, within the confinements of the backstop 21 and baffles 22, into the various sections or compartments within the ball receiver 20. The function of the backstop 21 is to dampen the impact of the propelled balls so that rebound will be negligible. The upright baffles 22 are intended to define the target areas and aid in segregating balls propelled within the said target areas. Balls hit into the center target area will drop into the center compartment of the said ball receiver. In so doing, the ball will roll down center chute 28 and through opening 30 where the light rays 33 are broken thus classifying the ball and indicating a directional accuracy score of one. Balls hit within either the right or left off-center areas of target 19 will drop into the right or left compartment respectively. In so doing, the ball will roll down chute 34 and through opening 35 to break the light rays 38 thus classifying the ball and indicating a directional accuracy score of two. Balls leaving openings 30 and 35 will drop down onto inclined ramp 40 and discharged out of said ball receiver 20 through opening 39.

Balls propelled within the floor target 43 are classified directly in the following manner. If the ball hits within the target area of cushion 46, the ball will roll downward and through opening 52. In so doing, the ball breaks the light rays 58 thus classifying the ball as having hit the center portion of the target and therefore an accuracy score of one will be alloted. If the ball hits within target area of cushion 47 the ball will roll downwardly within the annulus cushion and emerge through opening 51. In so doing, the ball breaks the light rays 55 thus classifying the ball as having hit within the off-center target area and the accuracy score of two will be indicated. If the ball misses target 43 completely an accuracy score of three will be alloted. The prime function of the said cushions 46 and 47 is to act as damping means to prevent balls propelled into said floor targets from rebounding out.

Figure 6:
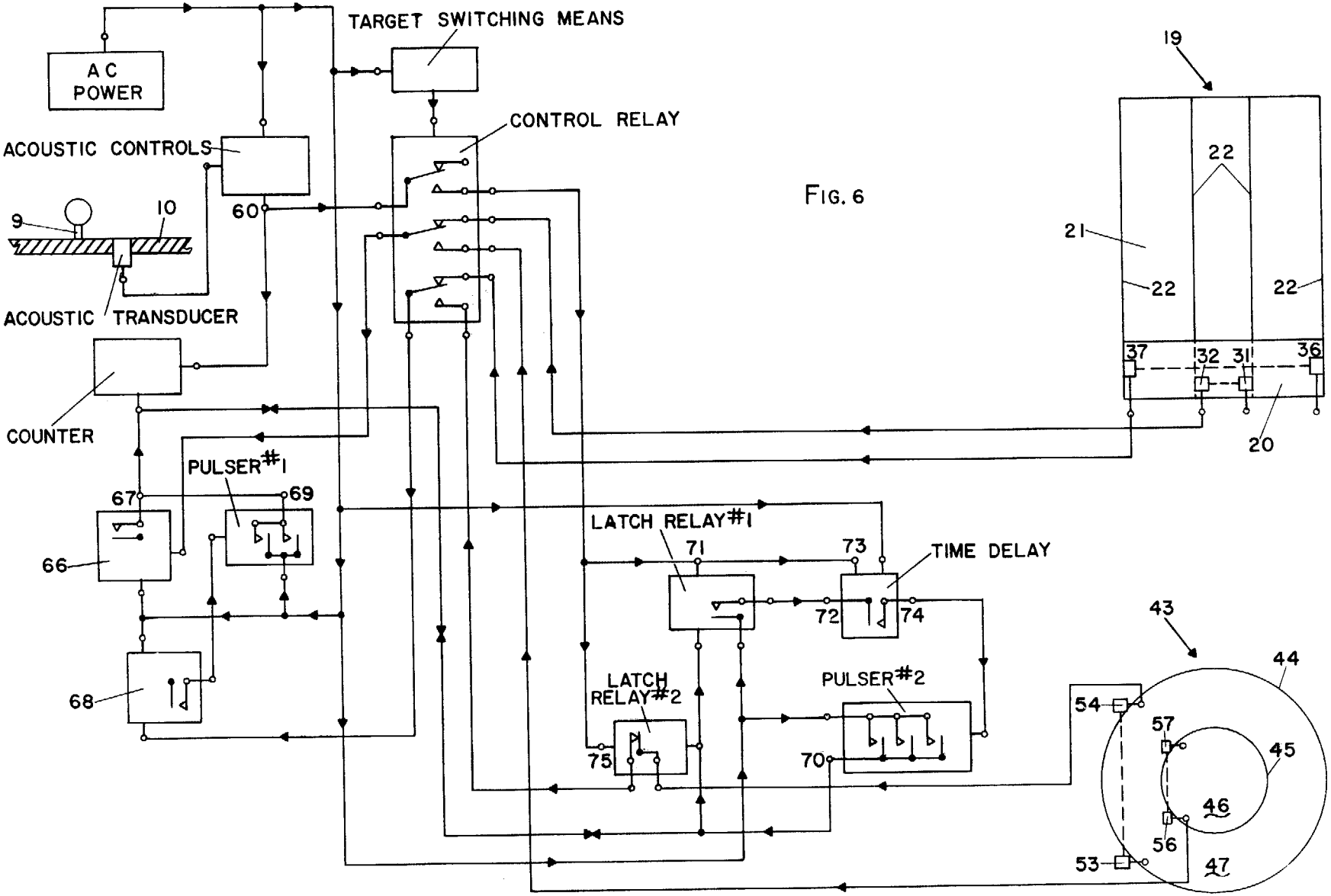
FIG. 6 depicts the golf tee and targets in conjunction with a functional schematic block diagram of the control circuitry utilized in the invention.

With reference to the block diagram of FIG. 6, the photoelectric and acoustic sensing system, the counter, the control relay, the latch relays, the time delay, the pulsers, and the D.C. power supply are standard commercially available components. Said cited components can be substituted for by equivalent devices classified as fluidic, electronic, electromechanical, etc. to yield a control system equivalent to that depicted and described herein.

The pulser or pulsing means for providing a preset number of pulses, is to be construed as a device which upon receiving an input start signal provides a preset number of output control pulses.

Acoustic sensing unit consists of the acoustic transducer and the acoustic controls.

Photoelectric sensing unit consists of the light source, and the photoelectric control.

Directional accuracy determining and indicating means for the vertical target is to be construed as any means functional in providing a numerical representation based on which discrete zone of a plurality of target zones was hit by a propelled ball. One possible means, as herein disclosed includes the use of pulsers, counter, vertical target baffles, ball receiver with associated ball detection means, and ancillary control devices such as depicted in FIG. 6.

Accuracy determining and indicating means for the floor target as herein disclosed includes such functionally associated components as pulsers, counter, vertical annulus walls, ball detection means, and ancillary control devices such as depicted in FIG. 6.

Ball halting means is to be construed as the vertical target and/or the floor target.

The target switching means in conjunction with the control relay is used as a selection means to either engage or disengage the vertical and floor targets into or from the control system. The said switching means can exist as pushbuttons when the system is not completely automatic. When automatic, said switching means can exist as relay contacts controlled by a programmer which dictates the golf shot sequencing mode of operation. This means that when balls are being hit toward the vertical target, the floor target will be deactivated and vice versa.

With reference to FIG. 6, which shows the controls set on the vertical target mode of operation, it can be discerned that when the ball is dislodged from the golf ball tee 9 the acoustic transducer picks up the sound of impact and transmits the signal to the acoustic controls which in turn operates to emit an output pulse from terminal 60. Said pulse will be conveyed to the indicating device or counter to reset it to a zero count. Now, after the ball hits said target 19 and gravitates into the ball receiver 20 the directional accuracy score will be provided dependent on which zone of said target was hit. If the center zone was hit, light source 31 in conjunction with photo sensor 32 will operate to send a signal through the contacts of the control relay to activate the photoelectric controls 66 which provides one pulse through terminal 67 to said counter to advance it one count such that the counter will display a score of 1 for the golf shot. If instead, the off-center zone was hit, light source 36 in conjunction with photo sensor 37 will operate to send a signal through the contacts of the control relay to cause the photoelectric controls 68 to emit a pulse to activate pulser No. 1. Said pulsing means or pulser, such as an electromechanical single cycle multi-cam programmer timer, will in turn emit two pulses from terminal 69 to said counter to advance it two counts such that said counter will display a score of 2 for the golf shot.

If the floor target is put into operation by the target switching means, the control relay will operate to switch all of its contacts such as to disengage the vertical target from the circuit and engage the floor target into the circuit. Now, with the controls set on the floor target mode of operation, it can be discerned that when a ball is dislodged from said tee 9 the acoustic controls will operate to emit an output pulse from terminal 60. Said pulse will be conveyed to the counter to reset it to a zero count, and through the contacts of the control relay to terminal 71 of latch relay No. 1 to effectuate the closing of its normally open contacts for conveyance of power therethrough to terminal 72 of the time delay. Also, said pulse will be conveyed to terminal 73 of said time delay to initiate its operation, and to terminal 75 of latch relay No. 2 to return its contacts to the closed condition when previously actuated open. After activation, said time delay such as an electromechanical single cycle multi-cam timer will emit a pulse from terminal 74 to activate the pulsing means or pulser No. 2 if the ball dislodged from said tee 9 does not enter said floor target within a specified time. For example, if no ball enters said floor target within say 5 seconds, pulser No. 2 will operate to emit three pulses from terminal 70 to said counter to register a count of 3 therein. However, if a ball enters the center portion of said floor target within said 5 second time limit, light source 57 in conjunction with photo sensor 56 will operate to send a signal through the contacts of the control relay to activate the photoelectric controls 66 which provides one pulse through terminal 67 to said counter to register an accuracy score of 1 for said golf shot. Meanwhile, since said ball has hit within said floor target within said 5 seconds, a pulse will be provided to the release coil of latch relay No. 1 to cause the return of its contacts to the normally open condition for termination of power to terminal 72 of said time delay. This essentially means that said time delay is de-activated since no pulse will be emitted from terminal 74 to activate pulser No. 2 after said 5 second time interval. Also, said pulse from terminal 67 will be conveyed to latch relay No. 2 to open its normally closed contacts, thus de-activating photo sensor 54 so that it will not cause operation of photoelectric control 68 when a ball hit into said center zone 46 finally rolls out through opening 51 of said annulus wall 44. If instead, the off-center portion of said target 43 is hit, light source 53 in conjunction with photo sensor 54 will operate to send a signal through the contacts of the control relay to activate the photoelectric controls 68 to emit a pulse to pulser No. 1. Activation of said pulser will provide two pulses through terminal 69 for conveyance to said counter to register an accuracy score of 2 for the golf shot. Since the ball has hit within said floor target, pulser No. 2 will be de-activated in the same manner as described above for balls hit within the center zone of said target. It is to be noted that power is provided to light source 31 and 36 when the upright target is in operation, and to the light source 53 and 57 when the floor target is in operation.

It is to be discerned that when the floor target mode of operation is in affect, subsequent operation of the apparatus will follow the same cycle of operation such as explained above for each ball dislodged from said tee 9.

Having thusly described the invention, the following is claimed:

1. A golf game apparatus, comprising a golfing lane having a golf ball tee disposed at one end from which golf balls are hit, ball halting means disposed at the opposite end for halting balls propelled from said tee, and accuracy determining and indicating means functionally associated with said tee and said ball halting means for automatically displaying a numerical accuracy representation for each ball hit from said tee; said accuracy determining and indicating means include pulsing means for providing a preset number of pulses representative of which area of said halting means is hit, and a remotely interconnected numeric indicating device operative in receiving and translating said pulses to provide a numeric display of said accuracy representation.

2. The invention as defined by claim 1, wherein said ball halting means is further characterized as being an upright target.

3. The invention as defined by claim 2, wherein said accuracy determining and indicating means is further characterized as including upright baffles mounted such as to separate said upright target into discrete zones.

4. The invention as defined in claim 3, wherein said accuracy determining and indicating means is further characterized as including a ball receiver disposed adjacent to said upright target.

5. The invention as defined by claim 4, wherein said accuracy determining and indicating means is further characterized as including ball detection means disposed with respect to said ball receiver for providing classifying information as to which zone of said target was hit.

6. The invention as defined by claim 5, wherein said indicating device is further characterized as a counter.

7. The invention as defined by claim 6, wherein said ball halting means is further characterized as including a horizontally disposed target.

8. The invention as defined in claim 7, wherein said horizontally disposed target is further characterized as a floor target having upright annulus walls therewithin for establishing center and off-center zones.

9. The invention as defined by claim 8, wherein said floor target is further characterized as including ball detection means for providing classifying information as to which zone of said target was hit.

10. The invention as defined by claim 9, wherein said center and off-center zones of said floor target are further characterized as containing cushions functional as damping means for preventing balls propelled into said target from rebounding out.

* * * * *